US005553677A

United States Patent [19]

Hinz

[11] Patent Number: 5,553,677

[45] Date of Patent: Sep. 10, 1996

[54] SURVEY PROCESS FOR CABLE CORE BORINGS AND DEVICE FOR IMPLEMENTING IT

[75] Inventor: Clemens Hinz, Marl-Sinsen, Germany

[73] Assignee: Bergwerksverband GmbH, Essen, Germany

[21] Appl. No.: 351,387

[22] Filed: Feb. 10, 1995

[30] Foreign Application Priority Data

Jun. 27, 1992 [DE] Germany ..... 42 21 221.9

[51] Int. Cl.[6] ..... E21B 47/00

[52] U.S. Cl. ..... 175/40

[58] Field of Search ..... 175/40, 44–46, 175/48, 50

[56] References Cited

U.S. PATENT DOCUMENTS 4,800,385 1/1989 Yamazaki ..... 175/40 X 4,901,804 2/1990 Thometz et al. ..... 175/40

5,096,001 3/1992 Buytaert et al. ..... 175/40

*Primary Examiner*—Michael Powell Buiz

*Attorney, Agent, or Firm*—John W. Carpenter

[57] ABSTRACT

A survey process for cable core borings in which an inner core tube (3) with an autarcally operating measuring probe (24) releasably secured via a core retaining sleeve adapter (20) is fed into a core boring rod (6) and blocked in an outer core tube (4) with a boring ring (2) via a core tube coupling (10, 11, 12, 13), measurements are taken in the open borehole by the measuring probe (24), the sensors of which look forwards through the boring ring on the withdrawal of the core boring rods (6), and temporarily stored time-dependently in the measuring probe (24), the measured depth is found by means of a rod travel indicator (1) and stored in a manner correlatable in time and, after the withdrawal of the inner core tube (3) with its measuring probe (24) secured to it, the measurements are read out from the measuring probe via a portable PC.

7 Claims, 2 Drawing Sheets

SURVEY PROCESS FOR CABLE CORE BORINGS AND DEVICE FOR IMPLEMENTING IT

Figure 1:
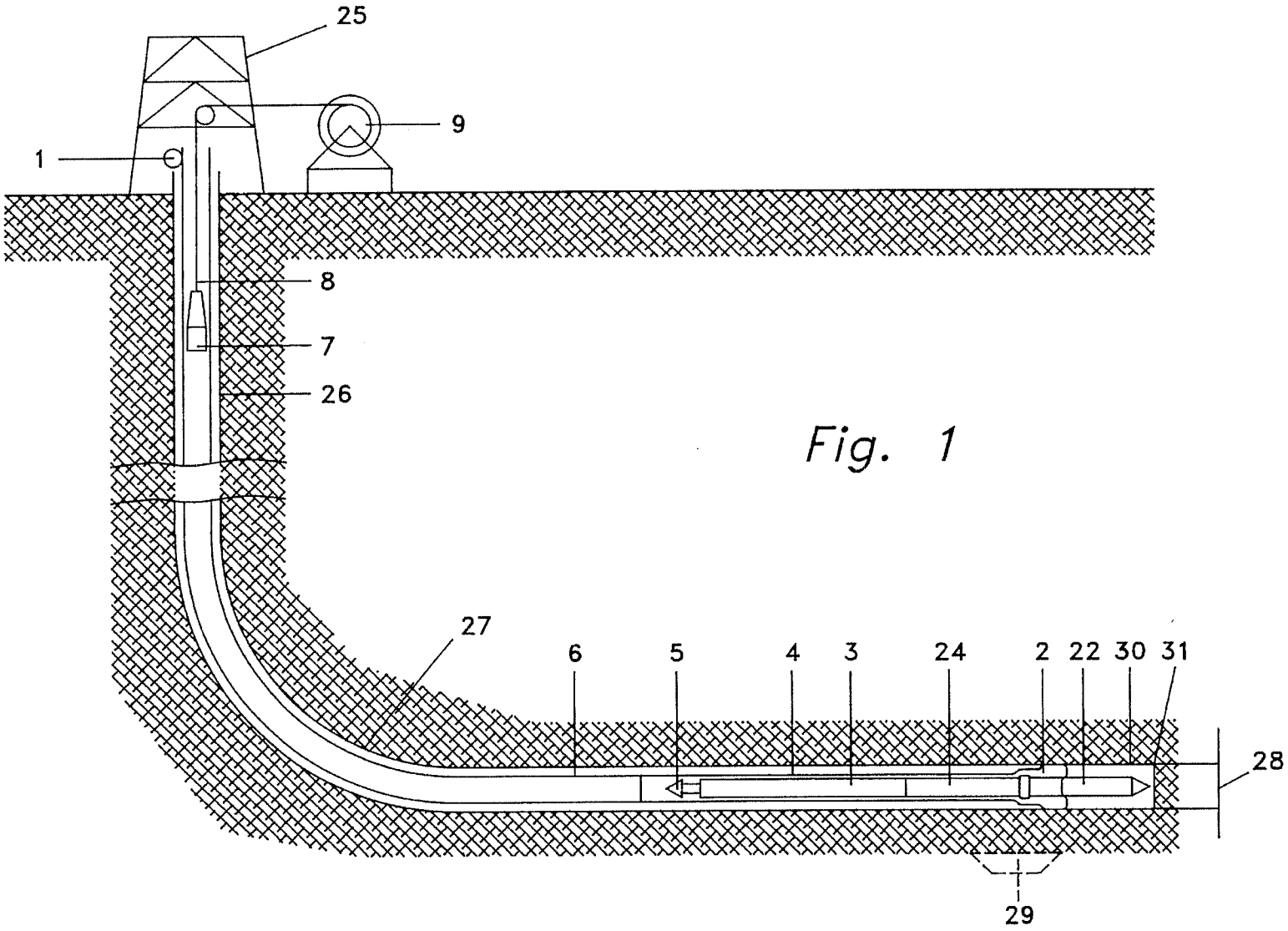

The invention concerns a survey process for cable core borings as well as a device for implementation of the process.

From the publication "HORIZONTAL WELL LOGGING BY 'SYMPHOR'", Eighth European Formation Evaluation Symposium, in London, 1983, a bore hole survey process and associated device is known with which especially horizontal or diverted borings can be surveyed, whereby the measuring probe is attached to the end of the boring rod and above ground between the boring rod and measurement truck a measurement cable is provided which can be moved via a cable winch. The measurement probe consists of a sinker mechanically and electrically connected with the cable shoe, on which a coupling rod is connected, to which the measuring devices are downstreamed. The probe further includes a coupling housing for connection to the boring rod and a protective housing for the measurement tools, which exhibits a measuring opening. With this measurement process and associated measuring device, it Is disadvantageous that the measuring probe is rigidly connected with the boring rode such that the boring rod must be disassembled before each measurement in order to disassemble the boring ring on the lower end of the boring string and install there the measuring probe.

Further, from "Efficiently log and perforate 60° wells with coiled tubing", WORLD OIL, July 1987, P. 32, 33, 35 a process and device for surveying is previously known by which in place of the boring rod, a special coilable tubing is used which works together with a special hose wench and on whose end a measurement probe is attachable, e.g. a gamma probe, a locating probe for tubage connections or an acoustic probe for testing soundness of the annular gap cement between the tubage and the ground. With this measurement process and device for its implementation, an expeditious investigation of such borings is possible for which the drilling tower is already removed. On the other hand, it is disadvantageous that a special wench and special tubing rod are necessary in order to carry out the necessary measurements.

Underlying the invention is the task of proposing a survey process suitable for cable core borings by which the disadvantages of the state of the art are avoided and by which it is possible to work with an exchangeable measuring probe without having to dismantle the boring rod. Further underlying the invention is the task of proposing a device for implementing the process according to invention.

Concerning the survey process, the task has been solved through the characteristics of patent claim 1.

Devices for carrying out the survey process in accordance with claim 1 are characterized through the features of claims 2 to 6.

The survey process according to invention for cable core boring and the associated device suit themselves optimally for geophysical survey of strongly deflected borings. With this new survey concept based on autarchically functioning survey probes which are washed into the rod using the usual core tube and whose probes view out in front of the boring ring, the dismantling of the rod before surveying is avoided such that work and time expense for the survey work can be quite essentially reduced. During the measuring process itself, no cable connection is necessary such that no expensive side entrances to the rod are needed. As the survey probe is housed within the rod, no survey probe losses occur.

Preferably, with every survey the depth change is recorded simultaneously via a rod path recorder and stored correlatable as to time. After conclusion of the survey, the measurement probe is recovered from the core tube and read out. Simultaneously, the measurement data and time and depth information are assigned and from this a depth data file is produced which can be plotted on location on a printer.

Figure 2:
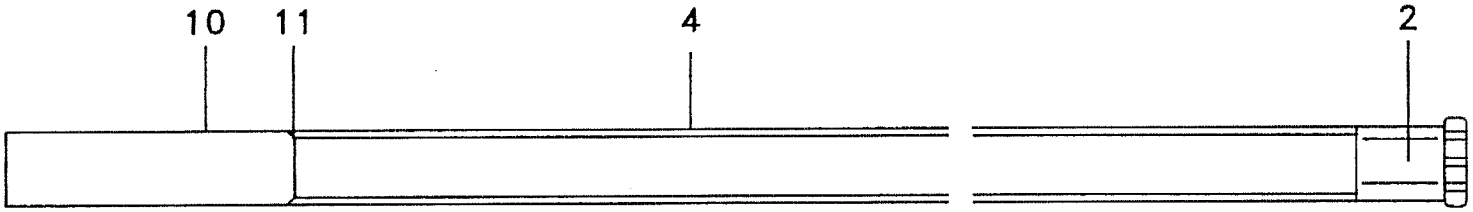
Figure 3:
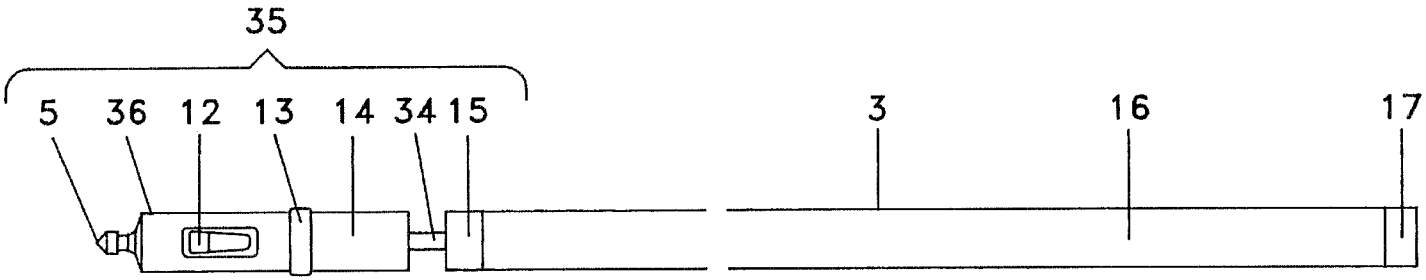

The invention is more exactly described using the drawings in the following as an example. Shown are:

FIG. 1 A schematic depiction of a surveying process for cable core borings as well as an outer core tube and an inner core tube with measuring probe for carrying out the procedure;

FIG. 2 an outer core tube with boring ring;

FIG. 3 an inner core tube and

Figure 4:
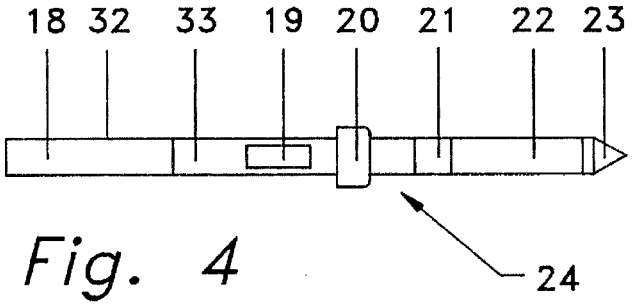

FIG. 4 a measuring probe arranged on an Inner core tube.

Depicted in FIG. 1 is the principle of the measuring process for cable core boring according to invention as well as an Outer Core Tube 4 equipped with a Boring Ring, with an Inner Core Tube 3, which is connected with Measuring Probe 24 and is connectable for recovery to a Core Tube Catcher 7. The Outer Core Tube 4 is connected to a Core Boring Rod 6 which is located in a Bore Hole 26 with a Deflected Part 27. The Inner Core Tube 3 with the Measuring Probe 24 fit into an Outer Core Tube 4 has, in the example of FIG. 1, already reached the deepest measuring point in front of the bottom of the boring by washing in with flushing fluid. Core Tube Catcher 7 is located still in the straight part of Bore Hole 26. It is moved—likewise washed in with flushing fluid—in the Core Boring Rod 6 on a Core Cable 8 to the Inner Core Tube 3 and connected to this via a Tap Catcher 5. Core Cable 8 is braked during insertion via a Cable Winch 9 and pulled out during extraction from Bore Hole 26. Cable Winch 9 is arranged next to a Boring Tower 25 which is erected over the Bore Hole 26. The path of the Core Boring Rod 6 is measured by a Rod Path Recorder 1 and saved in a correlatable manner over time.

The energywise autarchic Measuring Probe 24 has a Sensor Part 22 which has a measurement-technically clear access to the Wall 30 of the Bore Hole 26, 27 through Boring Ring 2 in order to obtain measurement data, for example concerning the structure of Ground 29 and of Bore Hole Wall 30 as well as of the Bore Hole Caliber 28.

FIG. 2 shows details of the Outer Core Tube 4 which carries Boring Ring 2 on one end and on whose other end a Lock 10 and a Landing Shoulder 11 for fixing Inner Core Tube 3 are attached.

From FIG. 3, the details of Inner Core Tube 3 are visible, whose outer dimensions allow insertion into Outer Core Tube 4. On Inner Core Tube 3 on one end is screwed a Core Retaining Sleeve 17 which contains the bore core bored out from Ground 29 during the boring process by means of Boring Ring 2 and following completion of a boring section carries the bore core by a Core Case 16 of Inner Core Tube 3 when this is brought to light of day for recovery with Inner Core Tube 3 from Bore Hole 26, 27. There the Core Retaining Sleeve 17 is screwed from Inner Core Tube 3 and the stone core is removed. For measuring Bore Hole 26, 27, in place of Core Retaining Sleeve 17, Measuring Probe 24 is screwed onto Inner Core Tube 3 via a Core Retaining Sleeve Adapter 20 and then is washed again into Core Boring Rod 6.

Core Case 16 is connected on its other end with a Core Tube Head which bears a Circulation Head 15 to which an Extraction Housing 36 is connected with variable length via a Threaded Spindle 34 which consists of a Rotation Bearing Part 14, a Landing Ring 13 and a Catch 12 to which Tap Catcher 5 is connected. Landing Ring 13 comes to rest on Landing Shoulder 11 during introduction of Inner Core Tube 3 into Outer Core Tube 4. In this position, Catch 12 of Core Tube Head 35 rests simultaneously in Lock 10 of Outer Core Tube 4. In this manner, Inner Core Tube 3 is securely anchorable in Outer Core Tube 7. With Tap Catcher 5, Core Tube Catcher 7 is connectable to Inner Core Tube 3 if Core Tube 3 should be released from its anchoring and need be extracted from Bore Hole 26.

Measuring Probe 24 is depicted in FIG. 4. From this depiction proceeds the general construction of Measuring Probe 24. It consists of a Sensor Part 22 with a Guiding Nose 23 and an Induction Coil 21 as well as a Core Retaining Sleeve Adapter 20. Sensor Part 22 protrudes during measurement out from Boring Ring 2. On the other side of Measuring Probe 24 is attached a Probe Tube 32 on Core Retaining Sleeve Adapter 20. Within Probe Tube 32 are contained an Electronics Part 33 with Data Memory 19 and a Battery 18 (as current source). Following connection of Measuring Probe 24 to Inner Core Tube 3, Probe Tube 32 is protectively housed in this.

1 Rod Travel Indicator
2 Boring Ring
3 Inner Core Tube
4 Outer Core Tube
5 Tap Catcher
6 Core Boring Rods
7 Core Tube Catcher
8 Core Cable
9 Cable Winch
10 Lock
11 Landing Shoulder
12 Catch
13 Landing Ring
14 Rotation Bearing Part
15 Circulating Head
16 Core Case
17 Core Retaining Sleeve
18 Battery
19 Data Memory
20 Core Retaining Sleeve Adapter
21 Induction Coil
22 Sensor Part
23 Guiding Nose
24 Measuring Probe
25 Boring Tower
26 Bore Hole
27 Deflected Bore Hole
28 Bore Hole Caliber
29 Ground
30 Bore Hole Wall
31 Bore Hole Bottom
34 Probe Tube
33 Electronics Part
34 Threaded Spindle
35 Core Tube Head
36 Extraction Housing

I claim:

1. A survey process for cable core borings comprising steps of:

(a) providing an inner core tube (3) having an outer core tube coupling (12,13) secured to one end thereof;

(b) providing a bore hole (26) having an outer core tube (4) situated therein, said outer core tube (4) having a boring ring (2) formed on one end and an inner core coupling (10,11) formed on another end thereof and having at least one core boring rod (6) coupled thereto;

(c) providing a self-contained measuring probe (24) for measuring sensed data and recording said sensed data;

(d) coupling said measuring probe (24) of step (c) to said inner core tube (3) of step (a);

(e) introducing said inner core tube (3) and said measuring probe (24) secured thereto into said outer core tube (4) of step (b);

(f) coupling said inner core coupling (10,11) of said outer core tube (4) with said outer core coupling (12,13) of said inner core tube (3);

(g) extracting said least one core boring rod and said outer core tube (4) coupled therewith and said inner core tube (3) and said measuring probe (24) coupled with said outer core tube (4) from said bore hole;

(h) recording simultaneously with said extracting step (g) sensed data with said measurement probe (24) in a manner correlatable over time; and (i) transferring said sensed data from said measuring probe (24) to a portable computer for subsequent correlation with elapsed time.

2. The process of claim 1 wherein said measuring probe (24) additionally comprises a core retaining sleeve adapter (20) fitted thereto for releasably securing to said inner core tube (3); said inner core tube (3) being coupleable to a core tube catcher (7) for recovery of said inner core tube (3), which is anchorable with said outer core tube (4), and said measuring probe (24) secured therewith; said core tube catcher (7) being secured to a core cable (8).

3. The process of claim 2 wherein said measuring probe comprises a sensor part (22), a guiding nose (23), an induction coil, said core retention sleeve adapter (20), and a probe tube (32); said probe tube comprising an energy supply (18), an electronics part (33), and a data memory (19).

4. The process of claim 3 wherein said inner core tube (3) additionally comprises a core case (16) which is connectable with said core retention sleeve adapter (20) of said measuring probe (24) for receiving said probe tube (32); said inner core tube (3) further additionally comprising a core tube head; said core tube head comprising a circulation head (15) for securing to said inner core tube (3) and an adjustable extraction housing (36); said adjustable extraction housing (36) comprising a rotation bearing part (14) having a threaded spindle (34) for coupling to said circulation head (15), a catch (12), a landing ring (13), and a tap catcher (5); said outer core coupling assembly comprising said catch (12) and said landing ring (13).

5. The process of claim 4 wherein said inner core coupling assembly (10,11) of said outer core tube (4) additionally comprises a landing shoulder (11) as buttress for said landing ring (13) of said core tube head (35) of said inner core tube (3) and a lock (10) for said catch (12) of said core tube head (35) of said inner core tube (3).

6. The process of claim 3 wherein said least one core boring rod (6) is coupled to a rod travel indicator (1).

7. The process of claim 4 wherein said least one core boring rod (6) is coupled to a rod travel indicator (1).

* * * * *